United States Patent [19]

Rankin et al.

[11] 4,444,004

[45] Apr. 24, 1984

[54] HAND-HELD TRAVERSABLE YARN SPLICER

[75] Inventors: Fred P. Rankin; Buren L. Goins, both of Gastonia, N.C.

[73] Assignee: A. B. Carter, Inc., Gastonia, N.C.

[21] Appl. No.: 333,255

[22] Filed: Dec. 21, 1981

[51] Int. Cl.[3] ..... B65H 69/06

[52] U.S. Cl. ..... 57/22

[58] Field of Search ..... 57/202, 22, 23, 6

[56] References Cited

U.S. PATENT DOCUMENTS

| | | | |
|---|---|---|---|
| 2,971,319 | 2/1961 | Spencer | 57/22 |
| 3,504,488 | 4/1970 | Illman | 57/22 |
| 3,526,085 | 9/1970 | Illman | 57/22 X |
| 3,668,852 | 6/1972 | Fusco et al. | 57/22 |

*Primary Examiner*—John Petrakes

*Attorney, Agent, or Firm*—Robert Brown, Jr.

[57] ABSTRACT

A portable hand-held traversable yarn end splicer adapted to be carried and operated by one hand of an operator while freeing the other hand to serve the splicer preparatory to, during, or after a splicing operation as conditions may require.

The invention is characterized by the splicer of the class described provided with: a traverse mechanism responsive to the grip of the holding hand of the operator for axially reciprocating a tensioned segment of a pair of oppositely extending overlapped yarn ends, a wrap wheel responsive to said grip for consecutively winding one or more helical courses of wrap thread around said segment, a stationary cutter responsive to said grip for severing the tail of the yarn end near the beginning of the first course, and a second stationary cutter responsive to said grip for severing the tail of the other yarn end near the end of the first course.

The invention is further characterized by a splicer of the type described that is provided with a wrap wheel responsive to manual reverse rotation for arresting it in proper position for receiving the broken yarn ends preparatory to the beginning of a splicing operation.

11 Claims, 22 Drawing Figures

FIG. 4
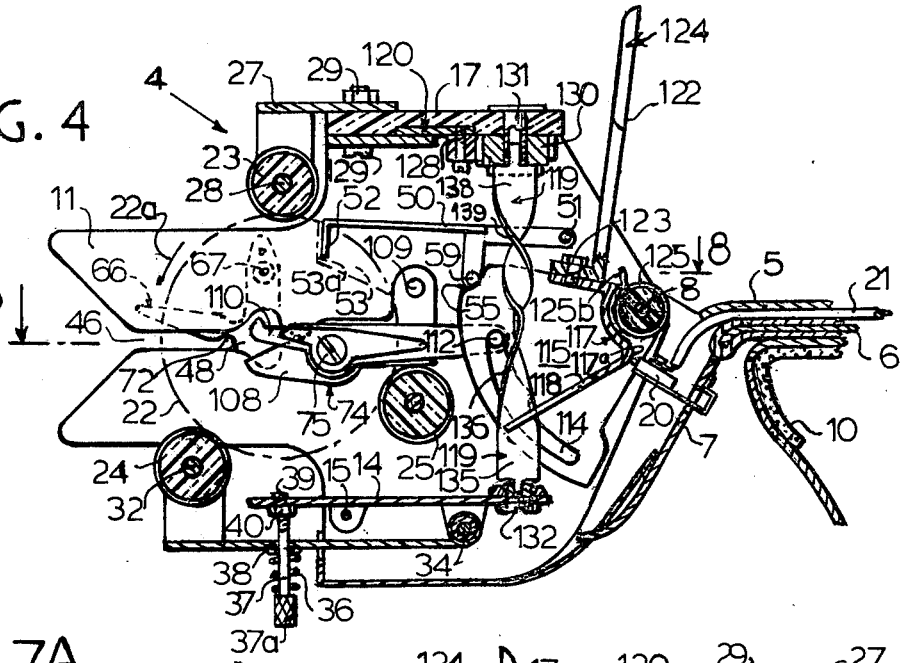
FIG. 7A
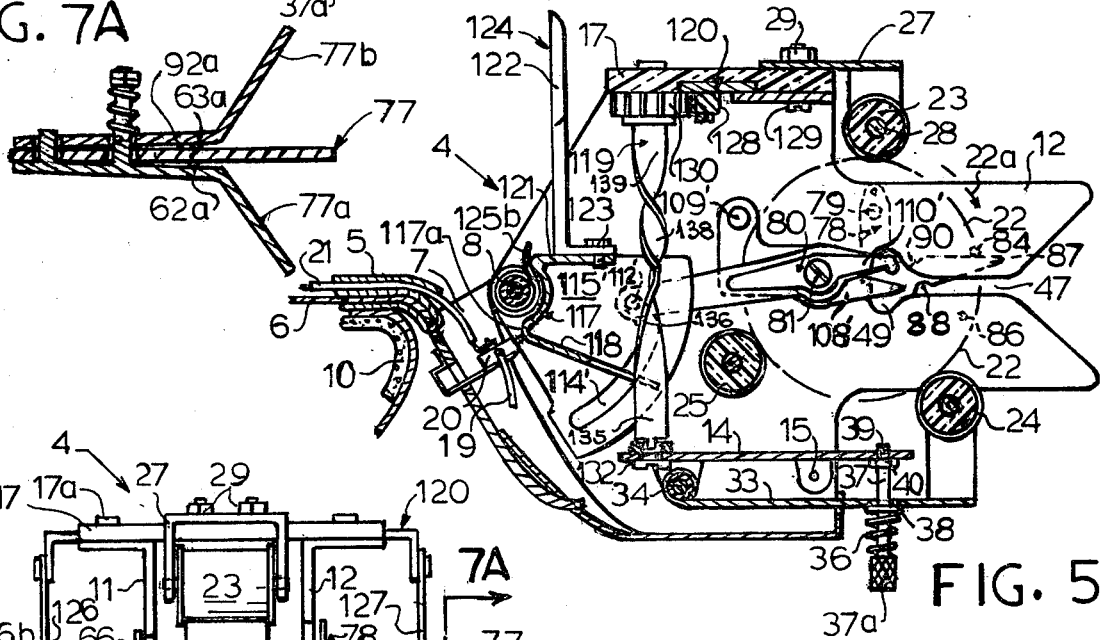
FIG. 5
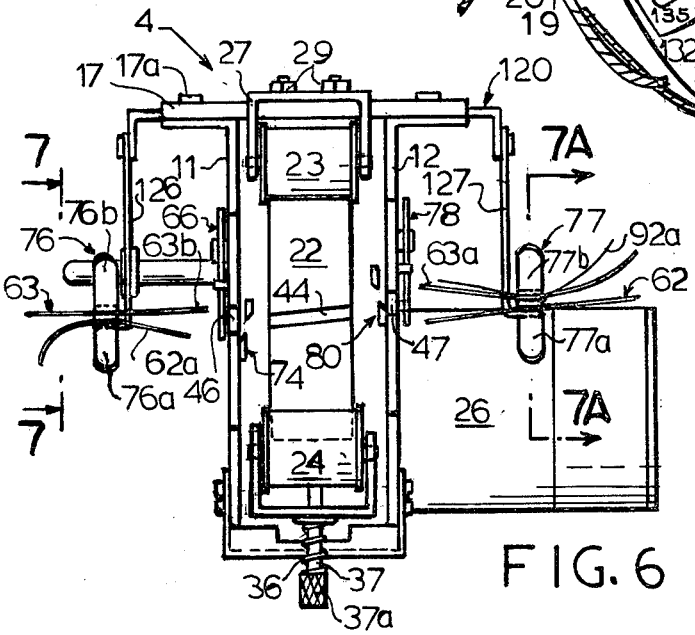
FIG. 6
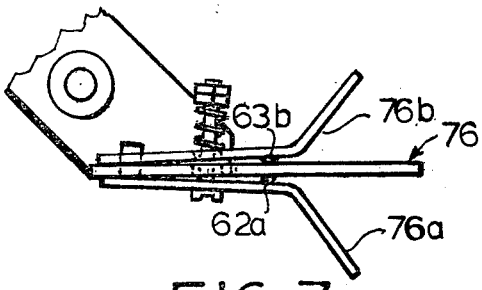
FIG. 7

FIG. 9
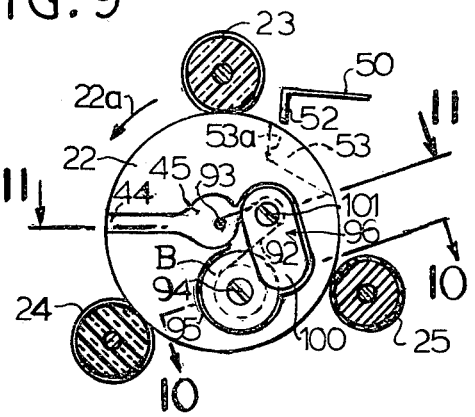
FIG. 11
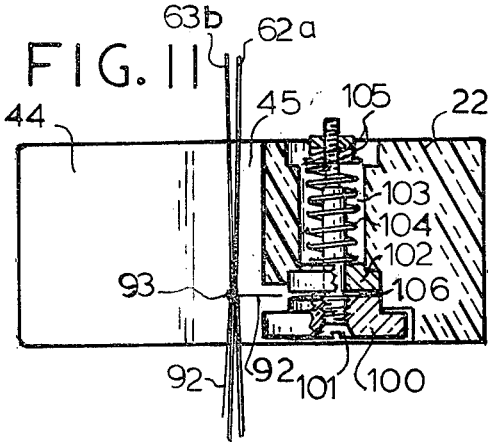
FIG. 10
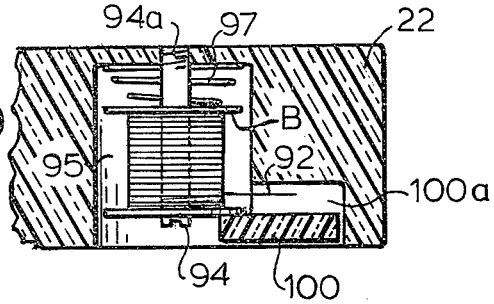
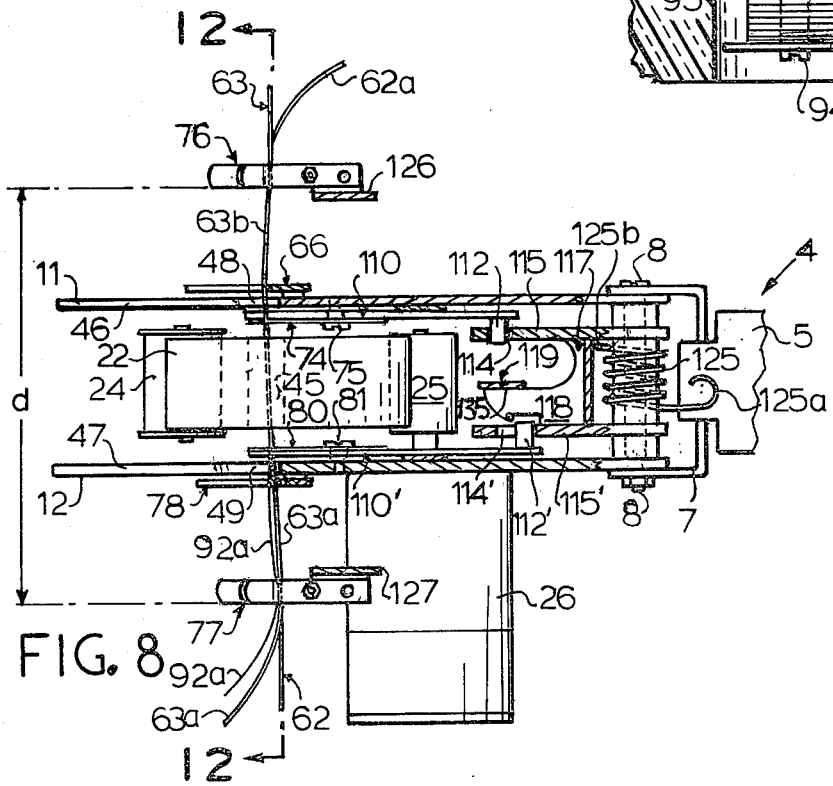
FIG. 8

FIG. 13
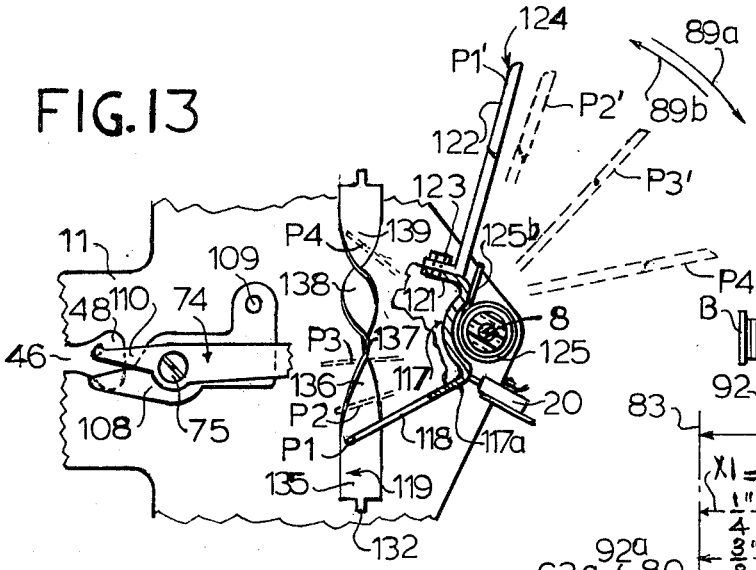
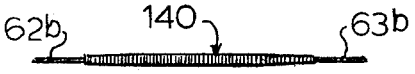
FIG. 16
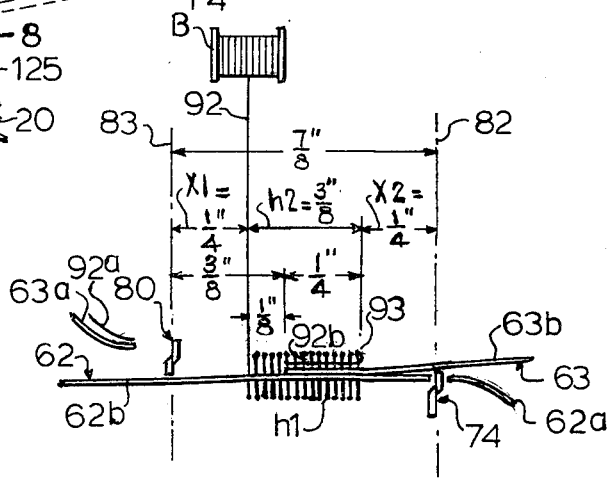
FIG. 15
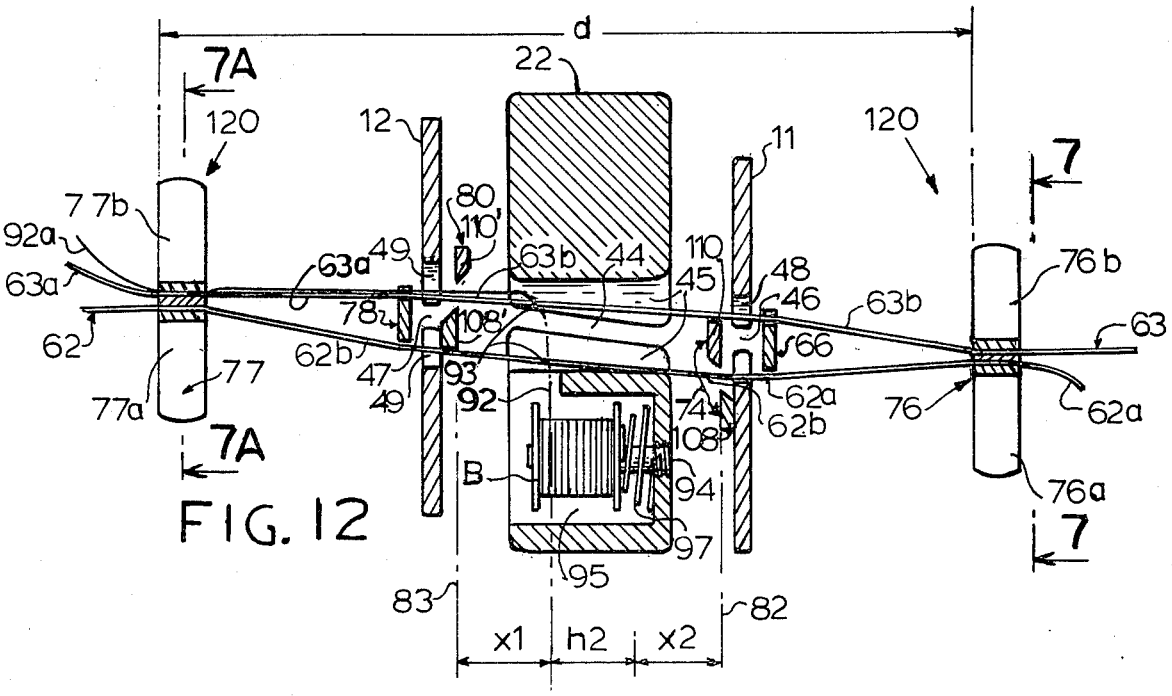
FIG. 12

HAND-HELD TRAVERSABLE YARN SPLICER

This invention relates to apparatus for uniting the broken limbs or ends of textile yarns and more especially to a hand-held and hand-controlled device for automatically splicing the yarn ends in an overlapped position by means of a helically wound wrapping thread. The invention comprises a rotary member for winding the thread around the overlapped ends, in combination with a traverse mechanism for axially moving the yarn ends back and forth relative to the rotary member while a helical wind is deposited therearound to unite the ends into a continuous length, and with cutters for severing the respective tails from the yarn ends near the beginning and the end of the first helical wind.

Heretofore, several methods and devices have been employed for uniting the broken ends of a textile yarn and other strand material with a helically wound wrapping strand. The patents to Wenzel U.S. Pat. No. 1,227,716; to Spencer U.S. Pat. No. 2,971,319 and to Illman U.S. Pat. Nos. 3,504,488 and 3,526,085 are typical examples of such prior art.

Wenzel discloses a process and apparatus for piecing together the ends of warp threads by clamping them at spaced points in substantially parallel positions while winding a wrapping thread around overlapped portions thereof. The apparatus is not hand-held and, hence incapable of being controlled by a holding hand. Neither is it provided with means for severing the tails from the respective warp ends, nor for covering such severed ends with a helical wind.

Likewise, the Spencer and Illman splicing devices are not capable of being held and controlled by the same hand; nor do they provide means for automatically severing the tails from the yarn ends after having been initially united, or for automatically covering the terminals of the cut ends with a helical wind.

The present invention is designed to join the broken end portions of yarn strands where knots would be objectionable or impossible to tie, or where knotless yarn is desired. The invention is especially suitable for splicing carpet, novelty, fiber, polypropylene, glass, asbestos yarns and the like.

So far as applicants are aware, there is no prior art or device that possesses the characteristic combination of features stated in the above abstract of the disclosure and the general description thereof.

It is therefore an object of this invention to provide a portable hand-held apparatus provided with a traverse mechanism for axially moving the overlapped broken ends of textile yarn strands while being spliced with a helical wind of a wrapping thread of relatively lesser denier.

It is another object of the invention to provide a splicing device of the type described in the preceding paragraph, in combination with means operable by the hand while holding the splicer for actuating the thread wrapping means, the yarn end traverse mechanism, and the yarn end severing means in timed relation to one another during the formation of a wrap splice.

It is a further object of invention to provide a hand-held splicer equipped with means for uniting the broken end portions of a pair of overlapped yarn strands, in combination with cutters for severing the respective tails from the strands on opposite sides of and near the point of unification.

Another object of the invention is to provide a yarn splicer having a radially slotted wrap wheel for receiving the segments of a pair of overlapped oppositely extending broken yarn strands to be spliced, in combination with mechanism responsive to manual reverse rotation of the wheel for arresting the reverse rotation when the slot becomes properly positioned to receive the segments.

Yet another object of the invention is to provide a textile yarn splicer adapted to be held and manipulated by one hand of the user at various elevations and ranges within arm reach of the user's holding hand during a splicing operation, thereby leaving the other hand of the user free to serve the splicer.

It is a still further object of invention to provide a yarn strand splicer of the class described and which is provided with a rotary twist plate and a follower thereof for controlling both the direction of axial movement and the rate of travel of the traversing yarns during a splicing operation.

With the foregoing objects in view, the invention consists of certain details of construction and combinations of parts hereinafter more fully described and pointed out in the appended claims. The invention itself, with additional objects and advantages will best be understood from the following description when read with the accompanying drawings, in which, FIG. 1 is a plan view of a hand-held traversable yarn splicer according to the present invention, omitting the yarn strands to be spliced, but in combination with a power source adapted to be worn by the user;

FIG. 4 is a longitudinal sectional view taken along line 4—4 in FIG. 1, showing the the thread wrapping wheel 22 in dot-dash lines for the purpose of illustration;

FIG. 5 is a longitudinal sectional view taken along line 5—5 in FIG. 1, also showing the outline of the wheel 22 in dot-dash lines;

FIG. 6 is a front elevational view looking at the left-hand ends of FIGS. 1 and 2, showing of the broken yarns and the wrapping thread at the beginning of a splicing operation;

FIG. 7 is an enlarged elevational view looking along lines 7—7 in FIGS. 6 and 12;

FIG. 7A is an enlarged sectional view taken along lines 7A—7A in FIGS. 6 and 12;

FIG. 8 is a longitudinal sectional plan view taken along lines 8—8 in FIGS. 5 and 6, showing the traverse clamps, the clamped yarn strands, the wrap wheel, and the twist plate that controls the rate and direction of movement of the clamps, cutters and associated elements as they appear at the beginning of a splicing operation;

FIG. 9 is a sectional detail view taken along line 9—9 in FIG. 1, showing the wrap wheel, its associated bobbin, the thread tensioning means and the path of travel of the wrap thread passing from the bobbin, through the tensioning means to the yarn splice;

FIG. 10 is a sectional detail view taken along line 10—10 in FIG. 9, showing the bobbin latched eccentrically within the wrap wheel;

FIG. 11 is a sectional detail view taken along the line 11—11 in FIG. 10, showing the means for mounting the tensioning mechanism in the wrap wheel;

FIG. 12 is a transverse sectional view similar to schematic Subfigure 14A and taken along the line 12—12 in FIG. 8;

FIG. 13 is a sectional detail view similar to the central portion of FIG. 4, showing the twist plate 119 and its associated control assembly 124 in bold lines at the beginning of a splicing operation, and further showing in dotted lines certain elements of the assembly in subsequent positions occupied during the operation;

FIG. 15 is an enlarged view of the central portion of schematic Subfigure showing the dimensional relationship of certain parts of a prototype constructed in accordance with the invention, and FIG. 16 is a view of a completed splice corresponding to the central portion of Subfigure 14F.

Figure 1:
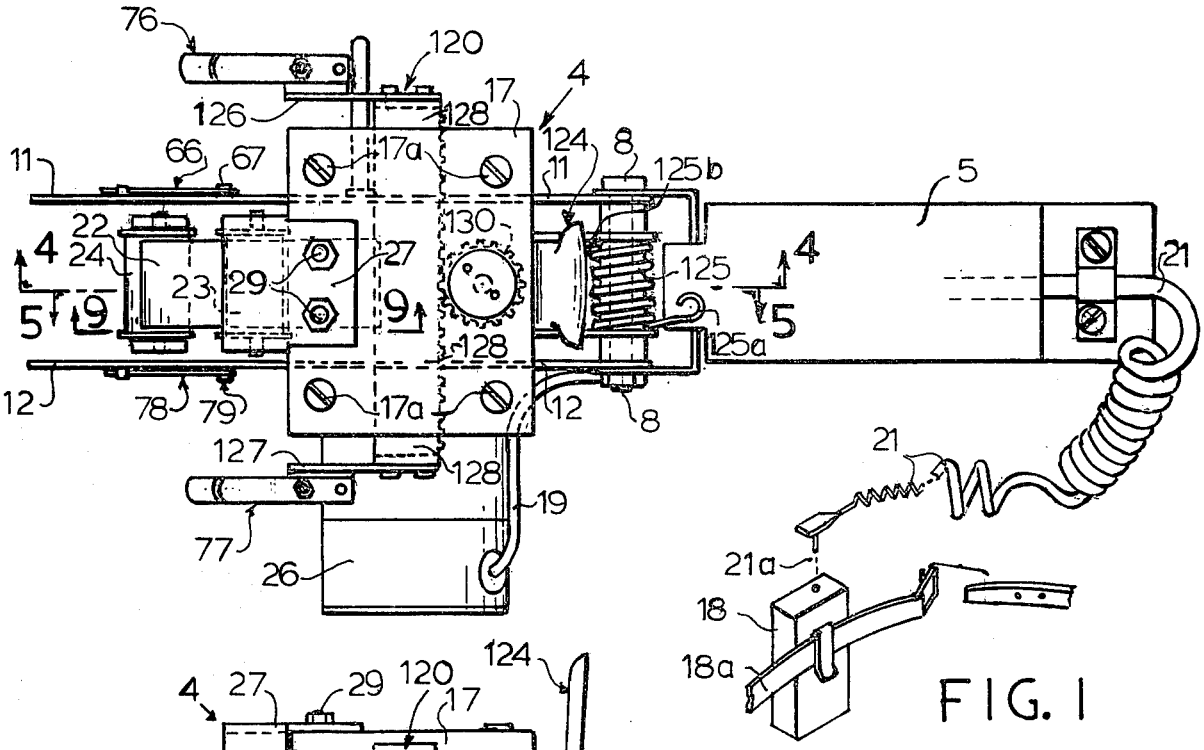

Referring more particularly to the drawings, the numeral 4 broadly designates a hand-held splicer having an elongated framework comprising parallel sidewall plates 11 and 12 which are separated at their bottom by a diaphragm plate 14 as at 15 and 34, and separated at their top by a cap plate 17 secured in position by screws 17*a*. The splicer 4 is provided with a suitable handle 5 consisting of a bar 6 integral with a U-shaped bracket 7 secured to the rear parts of plates 11 and 12 by a transversely disposed stud bolt 8 and screws 9, 9, Handle 5 is further provided with a strap and buckle assembly 10 for releasably fastening the splicer to the operator's hand. Suitable yarn cutters 74 and 80, later described, are mounted on the proximate faces of plates 11 and 12, said cutters having parallel shear planes 82 and 83, respectively, as shown in FIGS. 1–5, 12 and 14).

In order to facilitate further description, the splicer 4 will be oriented with respect to the user when the handle 5 is held by one of his or her hands and facing the overlapping transversely and axially extending broken end portions of the yarns 62 and 63 to be spliced. In such position, plate 11 will be disposed at the right of the user and the splicer, plate 12 at the left, yarn clamp assemblies 76 and 77 at the front, and handle at the rear.

As described hereinafter in the specification and claims, the handle 5 and lever 122 combined constitute a hand grip means adapted to be manipulated by the holding hand of the user to control the essential functions of the device during a splicing operation and independently of the other hand of the user.

THREAD WRAPPING MECHANISM

Figure 3:
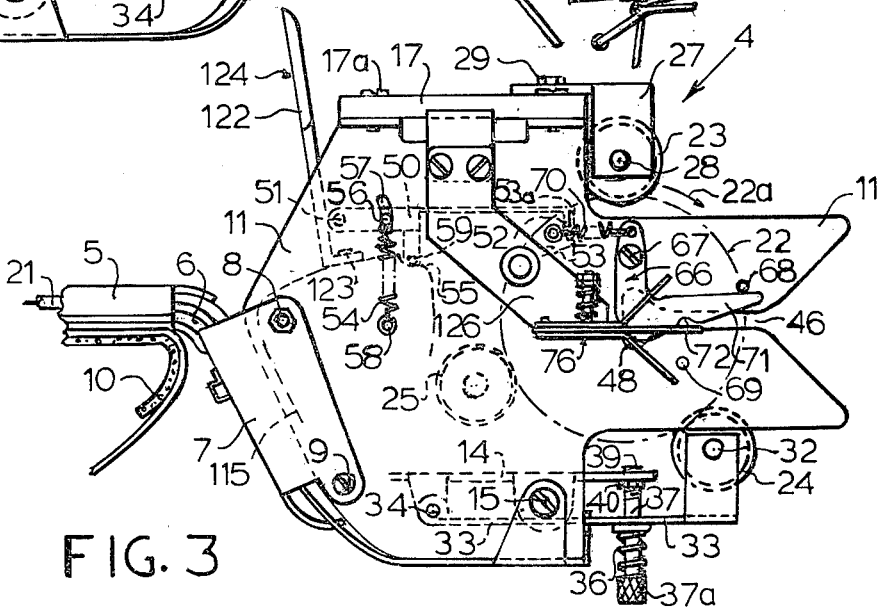
FIG. 3 is an elevation looking at the far side of FIG. 1.
Figure 14:
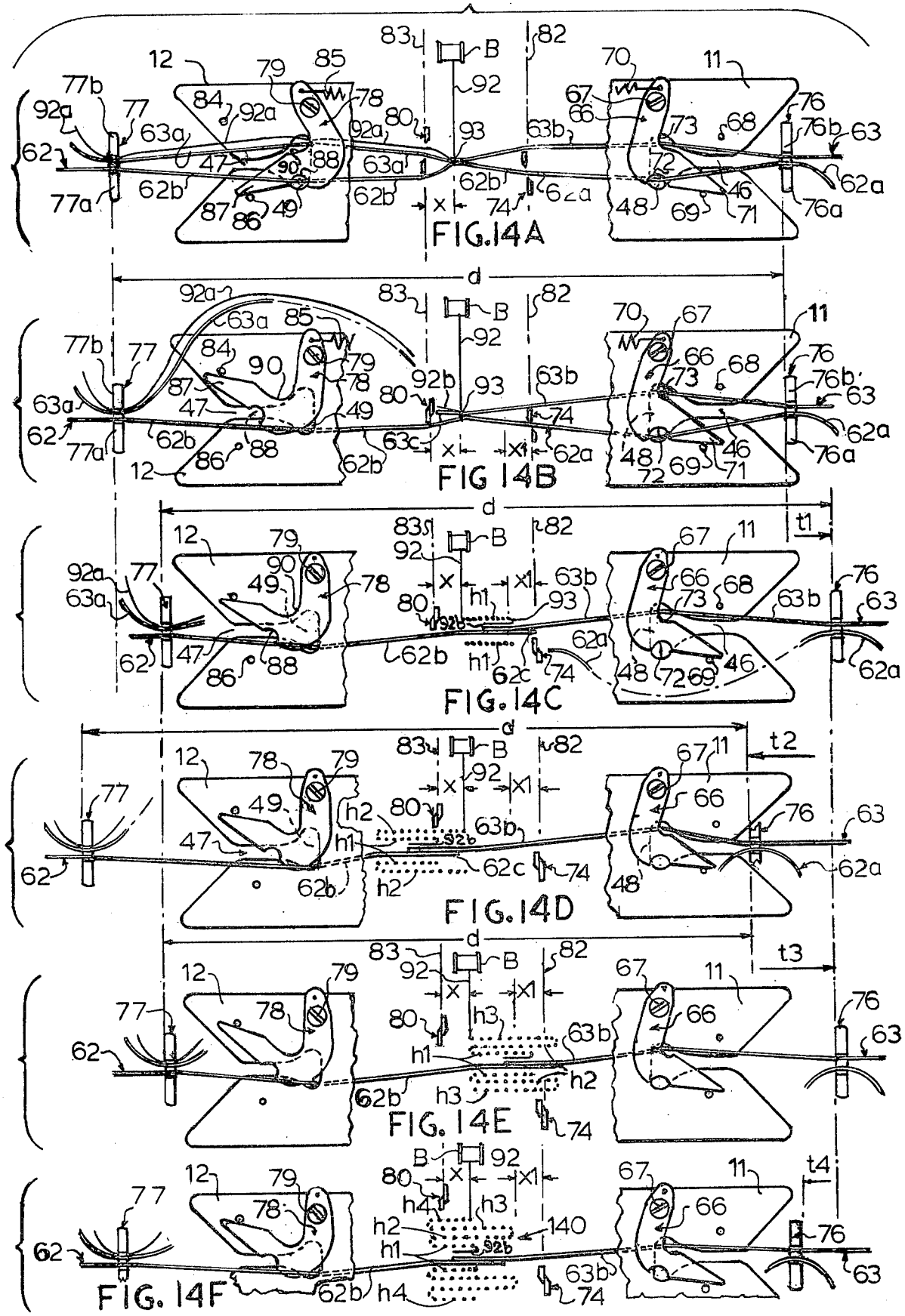
FIG. 14 is a group of schematic views looking forwardly of the splicer along line 12—12 in FIG. 8, but showing the outer faces of the sidewalls of the splicer in elevation, said FIG. 14 comprising Subfigures 14A through 14F which illustrate six consecutive positions of the splice-forming elements during the formation of a complete splice.

A bobbin B with a supply of wrapping thread 92 thereon is carried by a wrap wheel 22 which, in turn, is mounted between the front end portions of plates 11 and 12 by suitable means such as upper roller 23, lower roller 24, and a pulley 25 driven by motor 26. The rollers 23, 24 and pulley 25 tangentially engage the periphery of wheel 22 at circumferentially spaced points, the upper roller 23 being mounted upon the front end of a bracket 27 as at 28, which bracket is secured to cap plate 17 as at 29. Lower roller 24 is mounted in a similar manner as at 32 upon the front end of a flat bar 33 having its rear end pivotally mounted on said bolt 34 which extends transversely through plates 11 and 12 (FIGS. 3–5). The motor 26 causes drive pulley 25 to rotate wheel 22 in the direction of arrow 22*a* during a splicing operation. Inasmuch as the bobbin B is eccentrically mounted in wheel 22, the latter will orbit the thread bobbin around said overlapped broken end portions of strands 62, 63 to wind the wrapping thread therearound to form a splice.

To permit insertion and removal of the wrap wheel 22 to and from operating position, a compression spring 36 is mounted around the intermediate portion of a stud bolt 37, which bolt extends upwardly through a slot 38 in said pivoted bar 33, said bolt having its upper end threadably mounted in the diaphragm 14 as at 39 and having a knurled head 37*a* on its lower end. Spring 36 is confined between bolt head 37*a* and bar 33 to thereby cause roller 24 to yieldably engage the periphery of wheel 22 while pressing said periphery into engagement with the roller 23 and drive pulley 25, said yieldably pressure being adjustable by manipulating knurled head 37*a*.

The motor 26 is energized by means of a conventional circuit a battery 18 adapted to be worn upon the belt 18*a* of the operator, a switch 20, a conduit 19 leading from the motor to one side of the switch, and a second conduit 21 leading from the other side of the switch and detachably connected to the battery as at 21*a*.

Switch 20 is normally biased toward closed position; however, when the splicer is in its non-operating position and with lever 122 of manual control assembly 124 in its bold line position (FIGS. 4, 5 and 13), a short cam surface 117*a* on U-shaped follower unit 117 will hold the switch open, said unit being mounted for oscillation about the transversely extending stud bolt 8. A torsion spring 125 surrounds the bolt 8 and is adapted to bias the control assembly 124 toward non-operating position, said spring having one end thereof engaging handle 5 as at 125*a* and its other end engaging the lever 122 of unit 117 as at 125*b* (FIGS. 4 and 5).

Wrap wheel 22 has a strand receiving slot 44 therein (FIGS. 6, 11 and 12) which slot extends radially outwardly from its centrally disposed bore 45 to the wheel periphery. When the wheel is in strand receiving position, the slot 44 is aligned transversely with elongated guide slots 46 and 47 in sidewall plates 11 and 12, respectively, while the central bore 45, the end slots 48 and 49, the clamp assemblies 76 and 77 and the overlapping broken end portions of strands 62 and 63 are axially aligned transversely of the splicer.

In FIGS. 3, 4, 9 and 12, a one-way reverse motion preventer is shown for assisting the operator to manually align the radial slot 44 with guide slots 46, 47 to permit the yarn strands 62, 63 to be laterally inserted rearwardly of the splicer and to the starting position for a splicing operation as shown in FIG. 12. The preventer comprises a ratchet arm 50 pivoted at one end as at 51 to the inner face of plate 11, said arm having its forwardly extending free end provided with a short downturned lip 52 adapted to slidably engage either the periphery of wheel 22 or else a notch 53 in the wheel periphery during the period when the end of a splicing operation and the beginning of the next. Ratchet lip 53 is normally biased toward engaging position with the wheel periphery or the notch by means of a tension spring 54 (FIG. 3), the lower end of the spring being connected to a stud on the outer surface of plate 11 while its upper end is connected to a stud 56 extending laterally outwardly from ratchet arm 50, through a slot 57 in the plate. When splicer wheel slot 44 is properly aligned in its non-operating strand receiving position, the spring 54 causes a pin 59 on the free end of arm 50 to engage a notch 55 in the rear end of a cam plate 115 (FIG. 4). When the slot is unaligned with guide slots 46, 47 during the non-operation position of the splicer, the lip engages the wheel periphery, at which time, the manual reverse rotation of the wheel 22 will cause the lip 52 to engage wall 53*a* of notch 53 and arrest the wheel and slot 44 in aligned strand receiving position.

GUIDE AND SEPARATOR MECHANISM FOR THE BROKEN END PORTIONS OF THE YARN STRANDS

The broken yarn strand 62 comprises a tail 62*a* to be severed therefrom by the aforementioned cutter 74 and a continuous length or segment 62*b* remaining after severance. Similarly, the yarn strand 63 comprises a tail 63*a* to be severed therefrom by said cutter 80 and a continuous length or segment 63*b* remaining after severance. Operatively associated with the cutters 74 and 80 are a pair of clamp assemblies 76 and 77 which are carried by a traverse mechanism 120 and adapted to clamp the broken end portions of the yarn strands preparatory to the splicing operation and during the completion thereof (FIGS. 6, 7, 7A and 12). Assembly 76 comprises a lower spring-pressed section 76*a* for clamping the terminal of strand tail 62*a* and an upper spring-pressed section 76*b* for clamping the segment 63*b* of strand 63. The assembly 77 is identical to assembly 76, but is adapted to clamp the segment 62*b* of strand 62 in its lower section 77*a* while the upper section 77*b* clamps the terminal of the tail 63*a* of strand 63.

With the wrap wheel 22 in the above-described aligned starting position and for reasons which will be more apparent during further description, the overlapping oppositely extending portions of the yarn strands 62 and 63 should be successively inserted laterally into the open front ends of the guide slots 46, 47 and then into the end slots 48, 49 and bore 45 and clamp assemblies 76, 77. When properly inserted, the portion 62*b* of strand 62 will be disposed below cutter 80 and between the jaws of cutter 74, and the parallel overlapping portion 63*b* of strand 63 will be disposed above cutter 74 and between the jaws of cutter 80 as may be observed in FIGS. 8 and 12 and Subfigure 14A. Furthermore, the broken end portion of strand 62 should be inserted first with its broken terminal extending toward the right of the splicer when held by one hand of the operator, and then the broken end portion of strand 63 should be laterally inserted with its broken end portion extending toward the left of the splicer.

As best shown in FIGS. 9 thru 12, the wrapping thread 92 travels directly from bobbin B to the initial point of unification 93 of the broken strands 62 and 63, and then alongside the tail portion 63*a* and between the jaws of cutter 80 where the tail portion 92*a* will be severed concurrently with the severance of strand portion 63*a* as later described. The terminals of tail portions 63*a* and 92*a* are clamped in the upper section 77*b* of the clamp assembly 77 during the splicing operation.

The guide slot 46 and associated enlarged end slot 48 cooperate with a dual-acting L-shaped guide and separator 66 to position and confine the laterally inserted strand portion 62*a* at the bottom of the end slot and between the jaws of cutter 74, preferably of the scissor type, and also to position and confine the strand portion 63*b* thereabove at the top of the end slot and above the cutter. At the same time, the guide slot 47 and associated end slot 49 cooperate with dual-acting L-shaped yarn guide and separator 78 to position and confine the laterally inserted strand portion 62*b* at the bottom of the end slot and below cutter 80, preferably of the scissor type, and to also position and confine the laterally inserted strand portion 63*a* and the wrap thread tail portion 92*a* at the top of the slot and between the jaws of the cutter (FIGS. 2–5 and 12).

Figure 2:
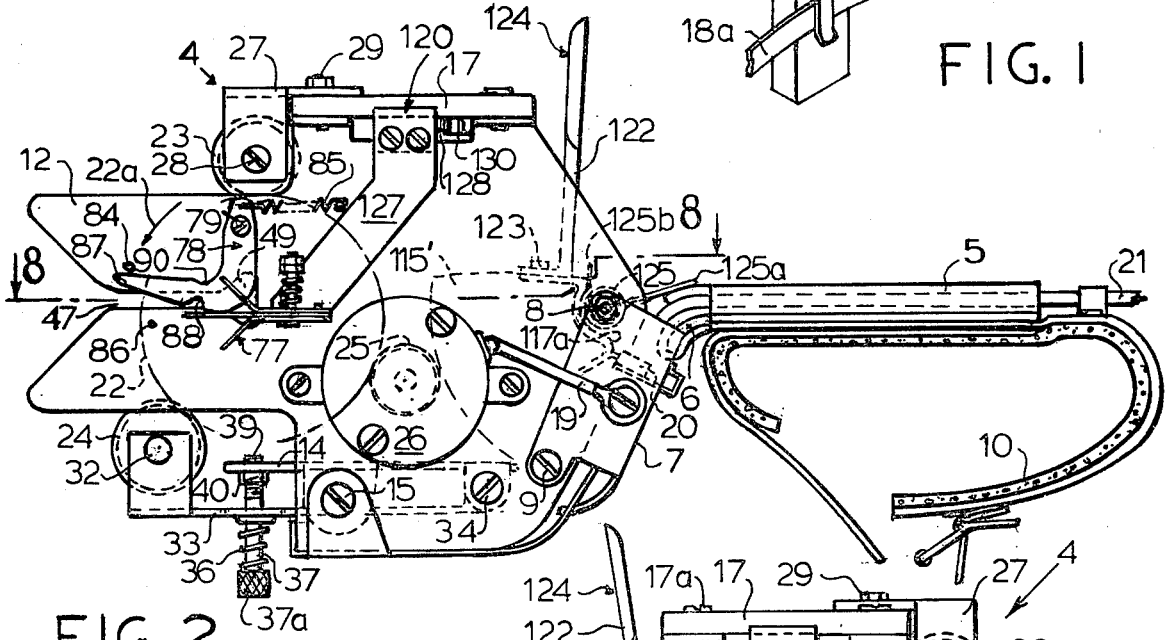
FIG. 2 is an elevational view of the splicer, looking at the near side of FIG. 1.

The L-shaped member 66 is normally biased toward a step 68 on the plate 11 by means of a tension spring 70. When leg 71 of member 66 engages stop 68 (FIG. 3), the tail 62*a* of strand 62 may be laterally inserted into guide slot 46 and then into engagement with notch 72 in the lower edge of the leg; and upon insertion of the tail 62*a* still farther, the member 66 will be rotated about its pivot 67 until leg 71 engages stop 69 to thereby guide the tail 62*a* into the bottom portion of end slot 48 and between the jaws of cutter 74. In a similar manner, the dual-acting L-shaped member 78 is normally biased toward a stop 84 on plate 12 by means of a tension spring 85 as shown in FIG. 2. When the leg 87 is engaged with the stop 84, the strand segment 62*b* may be laterally inserted into guide slot 47 and into notch 88 in the lower edge of leg 87; and upon insertion of the segment 62*b* still farther, the member 78 will be rotated about pivot 79 until leg 87 engages stop 86, thereby guiding the segment 62*b* into the lower part of end slot 49 to the position shown in FIG. 12.

With the legs 71 and 87 engaging the stops 69 and 86 and with the segments 62*a* and 62*b* at the bottoms of end slots 48 and 49, respectively, the segment 63*b* may be laterally inserted into guide slot 46, into the upper portion of end slot 48, and above cutter 74 while the yarn segment 63*a* and the thread tail 92*a* are laterally inserted into guide slot 47 and into the upper portion of end slot 49 and between the jaws of cutter 80 to the positions shown in FIG. 12 and Subfigure 14A where the broken end portions of yarn strands may be united as at 93 followed by subsequent splice-forming steps illustrated in Subfigures 14B thru 14F and later described.

BOBBIN RETENTION AND THREAD TENSIONING MECHANISM

It will be observed in FIGS. 9–12 that the wrapping thread 92 is drawn from bobbin B, through tensioning unit 96 and to the abovementioned unification point 93, said bobbin being rotatably mounted upon a stud bolt or pin 94 threadably secured as at 94*a* in the end wall of a bore 95 in wrap wheel 22. A compression spring 97 is disposed around an intermediate portion of bolt 94 and between said end wall and the proximate end of the bobbin. Thus, the spring 97 will normally urge the opposite end of the bobbin against a latch plate 100 which, in turn, has its lower end normally positioned within a slot 100*a* in wheel 22. The upper end of latch plate 100 is fixedly mounted upon a bolt or screw 101 which is parallel to said bolt 94, the intermediate portion of the bolt 101 being rotatably mounted and axially slidable in a bushing 102 fixedly secured in one end of a second 103 in the wheel 22 and parallel to bore 95. In order to hold the lower end of latch plate 100 against the outer end of the bobbin B and prevent the latter from being unintentionally expelled from its bore by the spring 95, a second compression spring 104 is disposed around the intermediate portion of bolt 101, one end of the spring engaging the end of fixed bushing 102 and the other end engaging an an adjustment nut 105 threadably secured on the end of bolt 101. It should be noted that the spring 104 is relatively stronger than spring 97 whereby the bobbin is caused to overcome the spring 97 when the latch plate 100 is confining the bobbin in its bore during normal operation.

The spring 104 serves the added purpose of yieldingly biasing the inner upper face of latch plate 100 axially toward engagement with the proximate parallel face of fixed bushing 102 as at 106, said parallel faces being adapted to frictionally engage the wrapping thread 92 therebetween and apply tension thereto as it travels from the tensioning unit 96 to the point of unification 93 and to the subsequently formed splice.

The bobbin B may be axially removed from bore 95 by applying axial pressure to the end of bolt 101 as at nuts 105 to cause the latch plate free lower end to relieve the pressure normally exerted by spring 104 and permit the weaker spring 97 to expel the bobbin after the free end of the plate has been rotated out of the axial path of the bobbin.

YARN TAIL CUTTING MECHANISM

The previously discussed cutters 74 and 80 illustrated in FIGS. 4, 5, 12 and 14 are similar in construction and are adapted to sever the tails 62*a* and 63*a* from strands 62 and 63, respectively, in the order named. As best shown in FIG. 4, the cutter 74 comprises a stationary jaw 108 secured to sidewall plate 11 as at 109 and operatively associated with a movable upper jaw 110 pivoted to the lower jaw as at 75. The jaws 108, 110 are shown in opened position and with the lower jaw 108 extending forwardly across the lower portion of the enlarged end notch 48 in plate 11. The unsevered tail 62*a* is positioned adjacent the lower portion of notch 48 at the beginning of a splicing operation as described above and as shown in FIG. 12 and Subfigure 14A and at the same time, the yarn segment 63*b* is disposed above the cutter 74 and adjacent the upper part of the notch.

In order to provide means for actuating the cutter 74 and sever the tail 63*a*, the rear end of the pivoted jaw 110 has a pin 112 extending therefrom and slidably mounted in an arcuate cam slot 114 of the previously mentioned cam plate 115, said plate being mounted for oscillatory movement upon the bolt 8 extending transversely through the rear end portions of sidewall plates 11 and 12.

The cutter 80 is similar in construction to the cutter 74 and comprises a stationary jaw 108' secured as at 109' to the inside face of sidewall plate 12, the latter jaw cooperating with an upper movable jaw 110' pivotally mounted thereon as at 81 (FIGS. 5, 8, 12 and Subfigure 14A), said jaws 109' and 110' being shown in their normal open position and extending forwardly of the splicer and partially across the upper portion of the end slot 49 so as to receive the unsevered tail 63*a* between the jaws when laterally inserted as previously described. At this time, the segment 62*b* of the strand 62 is disposed below cutter 80 and at the bottom of end slot 49. The rear end of movable jaw 110' is provided with a pin 112' slidably mounted in arcuate cam slot 114° of plate 115', which plate is mounted for oscillation about said stud bolt 8 in a plane parallel to said cam plate 115.

The proximate faces of cam plates 115 and 115' are integrally attached by the previously mentioned U-shaped unit 117 of the control assembly 124 (FIGS. 3, 4 and 8). The lower leg 118 of unit 117 serves as a follower of a twist plate 119 which is adapted to be oscillated in response to the manipulation of the control lever 122 secured to the other leg 121 of member 117 as at 123.

The cutter 80 operates in response to the oscillation of cam plate 115' immediately before, concurrently with or immediately after the strands 62 and 63 have been united at point 93, as previously described, to thereby sever the tails 63*a* and 92*a*. At this time, the free end swings alongside the flat segment 135 of the twist plate 119 and between the positions P1 and P2 where the movement of the follower will not impart any rotation to the twist plate, but instead will close or open the motor switch 20 causing a concentrated wind of the wrap thread 92 at point 93, around yarn segments 62*b* and 63*b*, as described later. The severance of tail 63*a* leaves the yarn segment 63*b* with a short uncovered end 63*c* of a length equal to the distance "x" between the initial point of unification 93 of strands 62, 63 and the shear plane 83 of cutter 80 as schematically shown in Subfigure 14A. The concurrent severance of the tail 92*a* of wrap thread 92 by cutter 80 will likewise leave a short uncovered end 92*b* alongside and of the same length as the end 63*c*.

YARN TRAVERSING MECHANISM

After the severance of the tails 63*a* and 92*a*, the follower 118 moves upwardly between positions P2 through P4 (FIG. 13) alongside the twist plate 119 to cause the traversing mechanism 120 and the united strands 62, 63 to move axially back and forth relative to the wrap wheel during the completion of the splice. The mechanism 120, as shown in FIGS. 1–6, 8 and 14, comprises the clamps 76 and 77, spaced a fixed distance apart "d" on opposite sides of the splicer, arms 127 and 127 for supporting clamps 76 and 77, a toothed rack 128 for supporting said arms and clamps, and a pinion 130 fixedly secured to the twist plate 119 and meshing with said toothed rack. The twist plate 119 has its upper end rotatably mounted in cap plate 17 as at 131 and its lower end rotatably mounted as at 132 in diaphragm plate 14.

When looking upwardly from the point 132 toward point 131 of the twist plate (FIG. 13), it will be observed that the plate comprises the above-mentioned flat section 135 at its bottom, a right-hand helical twist section 136, a short substantially flat section 137, a left-hand helical twist section 138, and a flat section 139 at its upper end, all of said sections occurring consecutively and being integrally formed into a unitary unit.

METHOD OF OPERATION

From the beginning to the completion of the splice 140, as best shown in Subfigure 14F and FIG. 16, the bobbin B is orbited by wrap wheel 22 to wind the wrap thread 92 in a stationary plane and around end segments 62*b*, 63*b* while control lever 122 swings about bolt 8 in the directions of arrows 89*a*, 89*b* in FIG. 13.

In response to the initial rotation of the follower 118 between positions P1 and P2 and alongside twist plate section 135 (FIG. 13), the transverse mechanism 120 and the segments 62*b* and 63*b* remain stationary, but the switch 20 is released to a closed position to cause motor pulley 25 to rotate wrap wheel 22 and to unite the segments as at 93.

In response to the initial rotation of follower 118 alongside twist plate section 136 and from position P2 toward position P3, the tails 63*a* and 92*a* of yarn 63 and wrap thread 92, respectively, are severed by cutter 80 (Subfigure 14*b*), thereby leaving the segment 63*b* with a short uncovered end 63*c* and the wrap thread 92 with an uncovered short end 92*b* as has been described in connection with the Cutter Mechanism above, said cutter 80 being operated concurrently with or immediately before or after the the segments 62*b* and 63*b* are united at point 93 and during the initial movement of the follower from position P2.

At this time, it is important to note that the winding of the first course h1 could no be continued from point 93 without first severing the tails 63*a* and 92*a* to permit the united yarn ends 62*a*, 63*a* and the clamped unsevered tail 63*b* to travel the distance t1 to the right of stationary cutter 80 as said course is wound and the severed ends 63*c* and 92*b* are covered (Subfigure 14C).

As the follower moves farther over section 136 toward position P3, the united strands 62, 63 and the unification point 93 will be moved by traverse mechanism 120 axially a predetermined distance t1 to the right as indicated in Subfigure 14C to form a helical wind or course h1 to the left of point 93, the wind h1 being of the same length as the distance t1. During the formation of the wind h1, the previously mentioned short ends 63*c* and 92*b* of yarn segment 63*b* and thread 92 will be covered by said wind. It should be further noted that as the point of unification 93 reaches the position which is short of the shear plane 82 of the cutter 74 by the distance "x1" (which distance is preferably the same as distance "x"), the follower 118 reaches position P3 on twist plate section 136 where the cutter 74 severs the tail 62*a* to thereby leave the end 62*c* uncovered.

It should be noted also that the winding of second course h2 could not be started of subsequently completed without first severing tail 62*a* to permit the united ends 62*b*, 63*b* and a part of course h1 to travel the distance t2 to the left of stationary cutter 80 whereby the severed yarn end 62*c* would be covered as shown in Subfigure 14D.

In order to verify the operability and illustrate the dimensional relationship of the elements of the partially completed splice after the formation of the helical wind h1 and the severance of the tail 62*a*, the central portion of schematic Subfigure 14C is repeated on an enlarged scale in FIG. 15, showing certain critical dimensions taken from a prototype of the splicer used in the preparation of this application. The prototype splicer was designed for parallel shear planes 82 and 83 spaced $\frac{7}{8}$ of an inch apart and with each of the distances "x" and "x1" having a length of $\frac{1}{4}$ inch.

As follower 118 continues its upward movement in FIG. 13 from position P3 and over the short twist plate section 137, the direction of movement of the traverse mechanism 120, the clamp assemblies 76, 77 and strands 62, 63 is initially reversed from right to left. Continued upward movement of the follower over twist plate section 138 will cause the strands to move axially to the left a predetermined distance equal to t2 (Subfigure 14D) while forming a helical wind h2 to the right of the end of and over the wind h1, the wind h2 having a pitch less than that of wind h1 and a length at least sufficient to cover said uncovered terminal 62*c* remaining on strand 62 after being severed by cutter 74 as shown in Subfigures 14C and 14D and FIG. 15.

The pitch of the succeeding wind h3 of the wrap thread 92 is the same as for wind h2, and the pitch of the last wind h4 is the same as that of the initial wind h1 because the pitch of the winds h1 and h4 is inversely proportional to the pitch of section 136 of twist plate 119, and the pitch of wind h2 is inversely proportional to that of section 138 of the plate. Therefore, the initial wind h1 and the last wind h4 during oscillation of control lever 124 (FIG. 13) will be closer than that of the intermediate winds h2 and h3.

The above-described successive continuous movements of follower 118 over the positions P1 through P4 correspond to the positions P1′ through P4′, respectively, of the thumb-actuated lever 122 in FIG. 13. The pressure exerted by the thumb of the holding hand of the user upon the lever 122 must be sufficient to move the follower while overcoming the torsional stress of spring 125, said spring normally biasing the lever toward position P1.

After the follower reaches the flat twist plate section 139 in position P4 and with lever 122 in position p4′, the manual pressure upon lever 122 of the hand grip means is relaxed to permit torsion spring 125 to rotate the lever and follower reversely in the direction of arrow 89*b* (FIG. 13) and from position P4′ to P3′.

During the rotation of lever 122 from position P4′ to position P3′, the united overlapped end portions of strand segments 62*a*, 62*b* will be moved axially to the right for a distance t3 (Subfigure 14E) to cause the formation of a helical wind or course h3 continuing from the end of course h2 and over the latter course for the distance t3, the length of course h3 preferably being the same as that for course h2.

Finally, the continued reverse rotation of lever 122 from position P3′ to position P2′ will move united segments 62*a*, 62*b* to the left for a distance t4 (Subfigure 14F) to cause the formation of a short course H4 continuing from the end of course h3 and over the latter to the right for a distance equal to the distance t4. At this stage, a completed splice 140 has been formed (FIG. 16) and the axial movement of the united strands ceases; however, the motor 26 and wrap wheel 22 continues to operate during the further rotation of the follower 118 and lever 122 from positions P2′ to P1′ where the motor switch 20 is opened and the thread wrapping ceases. The splice 140 is then removed along with the connected wrapping thread 92 and the latter manually severed or broken.

If desired, the splice 140 may be reinforced prior to its removal from the splicer by again rotating the lever 122 and follower 118 back and forth over positions P2 to P4 and P4′ to P1′ as described above.

We claim:

1. A portable device (4) adapted to be held and manipulated by one hand independently of the other hand of an operator to splice overlapped oppositely extending yarn ends (62*a*, 63*a*) comprising a frame including a hand grip means (5, 122), a wrap wheel (22) mounted on said frame for winding a splicing thread (92) around said overlapped ends, a traverse mechanism (120) mounted on said frame for reciprocatory movement in a path substantially parallel to said overlapped ends, said mechanism including a pair of clamps (76, 77) spaced apart at a fixed distance one from the other and disposed respectively on opposite sides of said winding means, said clamps adapted to releasably hold a segment of the overlapped ends under tension, and means responsive to said hand grip means for reciprocating said mechanism concurrently with the operation of said wheel to thereby consecutively wind at least two concentric courses (h1, h2) of said splicing thread around said segment to form a wrap splice, said responsive means including an elongated retatable element (119) provided with an axially disposed twist section (136) pitched in one direction and a second axially disposed twist section (138) pitched in the opposite direction, and a follower (118) carried by said hand grip means for successively engaging said sections.

2. The device defined in claim 1 wherein said wrap wheel includes a rotary member (22) having an axial opening (45) therethrough for laterally confining an intermediate portion of said yarn end segment, said member having an open ended slot (44) extending radially outwardly from said opening and rotatably alignable with said clamps to permit lateral insertion and removal of said segment into and from the opening and clamps preparatory to the splicing operation, and a thread supply (B) eccentrically mounted on said member.

3. The device defined in claim 2 and further comprising a pair of guideways (46, 47) mounted on said frame adjacent the opposite faces of said rotary member (22) respectively, the opposite ends of said slot (44) being rotatable into and out of coinciding alignment with said guideways during each revolution of said rotary member in the direction of wind of said splice, and means (50, 53, 54) operable preparatory to a splicing operation and responsive to the manual rotation of said member (22) reversely of said direction of wind for arresting the slot substantially in coinciding alignment with said guideways and clamps whereby said intermediate portion of the overlapped yarn end segment may be inserted and removed into and from said axial opening (45).

4. The device defined in claim 1 and further comprising a pair of spaced stationary cutters (74, 80) secured to said frame and disposed adjacent the opposite sides of said wrap wheel, and cam means (114, 114') responsive to said hand grip means for individually actuating said cutters to sever the tails from said yarn ends at points adjacent the beginning and the finish of said first course (h1), respectively.

5. The device defined in claim 4 wherein said first-named responsive means functions in the following order to: wind said thread (92) around said overlapping yarn end segment from said beginning point (93), over the severed yarn end (62*b*) adjacent said beginning point, and to the finish point of said first course (h1), reversely over said first course, and over the severed yarn end adjacent the finish point of said second course (h2).

6. The device defined in claim 5 wherein said wrap wheel includes a rotary member (22) having an axial opening (45) therethrough for laterally confining an intermediate portion of said yarn end segment, said member having an open ended slot (44) extending radially outwardly from said opening and rotatably alignable with said clamps to permit lateral insertion and removal of said segment into and from the opening and the clamps preparatory to a splicing operation, and a thread supply (B) eccentrically mounted on said member.

7. The device defined in claim 6 and further comprising a pair of guideways (46, 47) mounted on said frame adjacent the opposite faces of said rotary member (22) respectively, the opposite ends of said slot (44) being rotatable into and out of concurrent coinciding alignment with said clamps and guideways during each revolution of said rotary member in the direction of wind of said splice, and means (50, 53, 54) operable preparatory to a splicing operation and responsive to the manual rotation of said member (22) reversely of said direction of wind for arresting the slot substantially in coinciding alignment with said guideways and clamps whereby said intermediate portion of the overlapped yarn end segment may be inserted and removed into and from said axial opening (45).

8. A portable device (4) adapted to be held and manipulated by one hand independently of the other hand of an operator to splice overlapped oppositely extending yarn ends (62*a*, 63*a*), comprising a frame including a hand grip means (5, 122), a wrap wheel (22) mounted on said frame for winding a splicing thread (92) around said overlapped ends, a traverse mechanism (120) mounted on said frame for reciprocatory movement in a path substantially parallel to said overlapped ends, said mechanism including a pair of clamps (76, 77) spaced apart at a fixed distance one from the other and disposed respectively on opposite sides of said wheel, said clamps adapted to hold a segment of the overlapped ends under tension, a pair of spaced cutters (80, 74) fixedly secured to said frame and disposed on opposite sides of said winding means, means (119, 130) responsive to said hand grip means for reciprocating said mechanism concurrently with the operation of said winding means to consecutively wind at least two concentric courses (h1, h2) of said thread around said segment to form a wrap splice (140), a second means responsive to said hand grip means and including one of said cutters (80, 74) for severing a tail from one of the yarn ends near the beginning of said first course, and a third means including the other of said cutters and responsive to said hand grip means for severing a tail from the other of the yarn ends near the end of the first course.

9. The device defined in claim 8 wherein said wrap wheel includes a rotary member (22) having an axial opening (45) therethrough for laterally confining an intermediate portion of said yarn end segment, said member having an open ended slot (44) extending radially outwardly from said opening and rotatably alignable with said clamps (76, 77) to permit lateral insertion and removal of said segment into and from the opening and clamps preparatory to a splicing operation, and a thread supply (B) eccentrically mounted on said member.

10. The device defined in claim 8 and further comprising an electric motor (26) carried by said frame and drivably connected to said wrap wheel (22), and a switch (20) responsive to said hand grip means (5, 122) for activating and de-activating said motor.

11. The device defined in claim 1 and further comprising an electric motor (26) carried by said frame and drivably connected to said wrap wheel (22), and a switch (20) responsive to said hand grip means (5, 122) for activating and de-activating said motor.

* * * * *